US006953548B2

(12) United States Patent
Mancusi

(10) Patent No.: US 6,953,548 B2
(45) **Date of Patent: *Oct. 11, 2005**

(54) APPARATUS FOR TRANSFERRING LIQUID METALS FROM A COLLECTION CONTAINER TO A RECEIVING CONTAINER

(75) Inventor: Andrea Mancusi, Carmagnola (IT)

(73) Assignee: Teksid Aluminum S.r.l., Carmagnola (IT)

( * ) Notice: Subject to any disclaimer, the term of this patent is extended or adjusted under 35 U.S.C. 154(b) by 84 days.

This patent is subject to a terminal disclaimer.

(21) Appl. No.: 10/473,048

(22) PCT Filed: Mar. 22, 2002

(86) PCT No.: PCT/EP02/03270

§ 371 (c)(1),
(2), (4) Date: Sep. 26, 2003

(87) PCT Pub. No.: WO02/076656

PCT Pub. Date: Oct. 3, 2002

(65) Prior Publication Data

US 2004/0104520 A1 Jun. 3, 2004

(30) Foreign Application Priority Data

Mar. 27, 2001 (IT) ..... TO2001A0288

(51) Int. Cl.[7] ..... B65B 1/04
(52) U.S. Cl. ..... 266/239; 141/65; 222/595
(58) Field of Search ..... 266/239, 236; 222/595; 141/65; 164/34, 119

(56) References Cited

U.S. PATENT DOCUMENTS 3,826,646 A 7/1974 Karlsson et al.
4,378,836 A * 4/1983 Moussault ..... 164/336
4,844,142 A * 7/1989 Edge ..... 164/253
5,263,531 A * 11/1993 Drury et al. ..... 164/120
6,789,582 B2 * 9/2004 Mancusi ..... 164/34

FOREIGN PATENT DOCUMENTS

| | | |
|---|---|---|
| DE | 15 08 119 A | 10/1969 |
| GB | 1 024 953 A | 4/1966 |
| GB | 1 087 123 A | 10/1967 |
| GB | 1 390 636 A | 1/1975 |
| LU | 38 361 A A | 3/1960 |

* cited by examiner

*Primary Examiner*—Scott Kastler
(74) *Attorney, Agent, or Firm*—Sughrue Mion, PLLC

(57) ABSTRACT

Apparatus for transferring liquid metals from a collection container (9) to a receiving container (1), comprising: a receiving container in the form of a ladle (1) provided with a mouth (4) for the introduction of the metal, means (8) for transferring the liquid metal from a collection container (9) to the ladle (1), the means comprising a cover (7) which can engage the mouth (4) of the ladle (1) in a leak-tight manner and which has a first opening (14) with which a liquid-transfer duct (11) is associated and at least one second opening (16) with which means (17, 18) for generating a reduced pressure are associated, and handling means (20) arranged for moving the transfer means (8) between a position in which the cover (7) engages the mouth (4) of the ladle (1) and the transfer duct (11) is immersed in the collection container (9) and a position of disengagement from the mouth (4) of the ladle (1).

7 Claims, 3 Drawing Sheets

APPARATUS FOR TRANSFERRING LIQUID METALS FROM A COLLECTION CONTAINER TO A RECEIVING CONTAINER

This is a National Stage Entry of Application No. PCT/EP02/03270 filed Mar. 22, 2002; the disclosure of which is incorporated herein by reference.

BACKGROUND OF THE INVENTION

The present invention relates to apparatus suitable for transferring liquid metals between two separate containers, for use in the field of foundry technology.

In foundry processes, there is often a need to transfer metals in the liquid state between two different positions, for example, from a smelting furnace or from an intermediate container to a receiving ladle which in turn is intended to decant the metal into another operative device such as a casting form, an ingot mould, or a tun dish.

Moreover, in the course of the various metal decanting and transfer operations, there is also a need to provide for degassing of the metal before it is supplied to the above-mentioned operative devices.

SUMMARY OF THE INVENTION

The object of the present invention is, in particular, to provide apparatus which enables metals to be transferred easily, in the liquid state, between two positions, irrespective of their location and without limitation of time or quantity, with the additional advantage of enabling the function of degassing of the metal decanted to be combined, sequentially, with the transfer of the metal into the receiving container.

A further object of the invention is to provide apparatus which can limit transfer times and also thermal losses which necessarily occur in the course of the transfer.

In view of the above-mentioned objects, a subject of the invention is an apparatus for transferring liquid metals from a collection container to a receiving container, characterized in that it comprises:

- a receiving container in the form of a ladle provided with a mouth for the introduction of the metal,
- means for transferring the liquid metal from a collection container to the ladle, the means comprising a cover which can engage the mouth of the ladle in a leaktight manner and which has a first opening with which a liquid-transfer duct is associated and at least one second opening with which means for generating reduced pressure are associated, and
- handling means arranged for moving the transfer means between a position in which the cover engages the mouth of the ladle and the transfer duct is immersed in the collection container, and a position of disengagement from the mouth of the ladle.

BRIEF DESCRIPTION OF THE DRAWINGS

Further characteristics and details of the apparatus according to the invention will become clear from the following detailed description, given with reference to the appended drawings, provided purely by way of non-limiting example, in which.

DETAILED DESCRIPTION OF THE INVENTION

Figure 1:
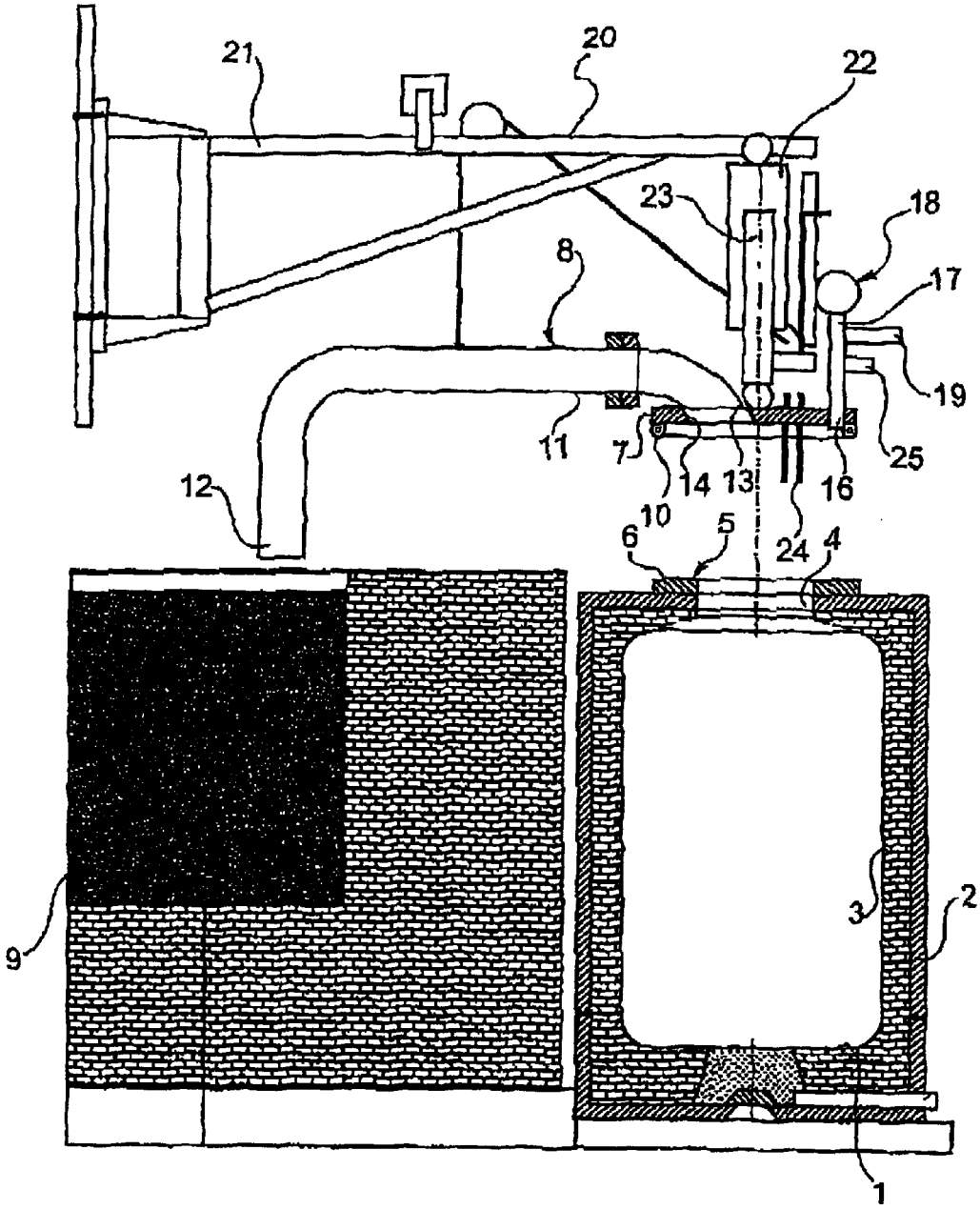
FIG. 1 is a schematic view of the apparatus.

With reference to the drawings, a ladle of the type conventionally used in foundry processes is generally indicated 1 and comprises an outer metal structure 2 and a refractory lining 3. Gripping or engagement means will be associated with the outer wall 2 of the ladle 1, in conventional manner to enable it to be manipulated in order to decant the liquid metal it contains into an operative device.

The ladle 1 has an upper mouth 4 for the introduction of the liquid metal, optionally having an associated annular flange 5 provided with an upper annular surface 6 defining a leaktight seat for the fitting of a cover 7. The flange 5, or similar means suitable for cooperating with a leaktight cover 7, may be used in order to adapt a conventional ladle 1, which is not generally arranged to be closed in a leaktight manner, to receive the above-mentioned cover 7 or equivalent sealing means.

Means for transferring the liquid metal from a collection container 9, which is constituted, for example, by a smelting furnace, to the ladle 1, are generally indicated 8. These means comprise the above-mentioned cover 7, which preferably has a seal 10 for cooperating with the mouth of the ladle 1 in order to seal it in a leaktight manner.

A siphon-like metal-transfer duct 11 is associated with the cover 7 and has a free end 12 to be immersed in the liquid metal of the collection container 9 and another end 13 which is fitted in an opening 14 of the cover 7. The cover 7 has at least one second opening 16 through which a suction duct 17, communicating with a vacuum pump 18 and with a reduced-pressure valve 19, is inserted.

The transfer means 8 can be associated with handling means 20, for example, comprising an articulated arm 21 and a hoist 22 with a pneumatic jack 23 which can be connected to the cover 7 to enable the transfer means 8 to be lifted and positioned on the mouth 4 of the ladle 1 and in the collection container 9.

In order to perform the liquid-transfer step, with the aid of the handling means 20, the end 12 of the duct 11 is immersed in the liquid metal of the collection container 9 and the cover 7 is brought to a position of leaktight engagement on the mouth 4 of the ladle 1.

Figure 2:
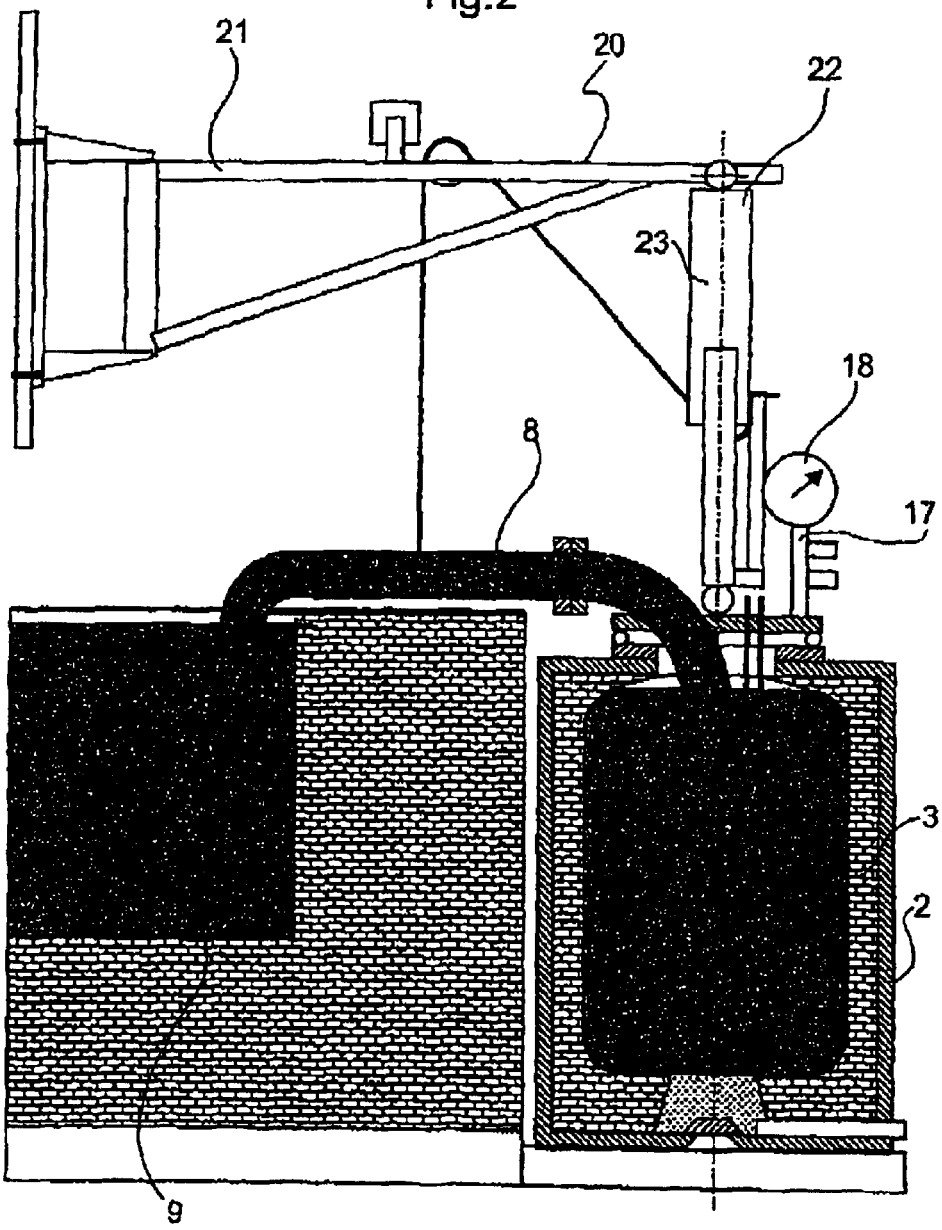
FIG. 2 is a schematic view of the apparatus of FIG. 1 in the operative liquid-transfer stage.

The configuration achieved is shown in FIG. 2; at this point, the system for generating a reduced pressure inside the ladle 1 is activated so as to bring about the transfer of the liquid from the container 9 to the ladle 1. Upon completion of the transfer of the liquid, ambient pressure conditions are re-established by opening of the valve 19 and, at this point, the transfer means 8 can be moved and brought outside the operating area.

Electrodes 24 may advantageously be associated with the cover 7 to act as sensors for detecting the presence and the level of the liquid metal; these sensors may advantageously be associated with a control and operating unit arranged to receive the signal generated by the electrodes 24, which is indicative of the presence of liquid metal in the ladle 1, and to interrupt the activation of the reduced-pressure generating means and to interrupt the transfer of the liquid when the liquid level reaches a predetermined value.

An auxiliary safety valve 25 may also advantageously be associated with the duct 11 and arranged to discharge to the exterior any gases generated by the molten metal, which may give rise to overpressures inside the ladle 1 in the course of the transfer and decanting operations.

The apparatus of the invention enables the liquid to be transferred from any desired collection container 9 or from several collection containers, without substantial limitations of time or of the quantity of liquid to be transferred; moreover, thermal losses are substantially limited.

Figure 3:
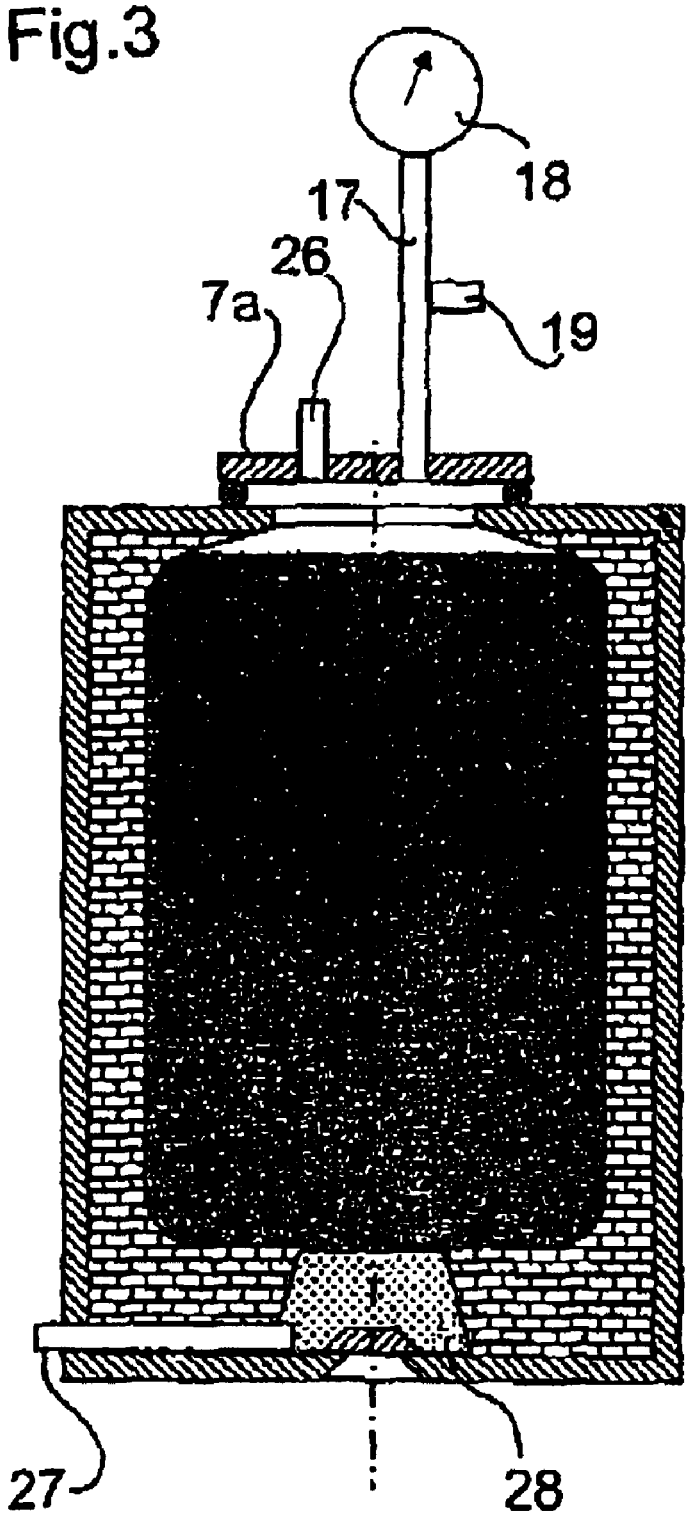
FIG. 3 is a schematic view of the apparatus in the auxiliary degassing stage.

The apparatus can advantageously also be arranged to perform a degassing operation, sequentially with the transfer of the liquid. For this purpose, an auxiliary cover 7*a* (FIG. 3), provided with a duct 26 for the evacuation of the degassing gases and a duct 17 communicating with a vacuum pump 18 as described above, may be associated with the ladle 1.

The degassing operation may be performed by sealing the mouth of the ladle 1 in a leaktight manner and supplying an inert gas through a blowing duct 27 communicating with a porous partition 28 of ceramic material acting as a gas diffuser and positioned in the base of the ladle 1. The degassing operation is performed by the blowing-in of inert gas and the simultaneous generation of a reduced pressure. The cover 7*a* may in turn be associated with the handling means 20, 21 and 22 described above.

It has been found that the degassing operation performed in the conditions mentioned above brings about a considerable improvement in the quality of the slag, avoiding the need to protect the metal bath with salts during the execution of this operation.

It is intended that the same degassing operation may be performed without the need to use an auxiliary cover 7*a*, but with the use of the cover 7 described above, with which a duct 26, provided with an on-off valve to be closed during the liquid-transfer operation, may be associated for the evacuation of the degassing gases; in this case, it is intended that an on-off valve, to be closed in turn during the degassing operation, may be associated with the duct 11 or with the opening 14 of the cover 7.

In particular, the apparatus according to the invention enables substantial and advantageous operative flexibility to be achieved for the liquid-transfer and degassing operations. Moreover, the apparatus can be fitted, by simple adaptation operations, on ladles that are conventionally in use.

Naturally, the principle of the invention remaining the same, the forms of embodiment and details of construction may be varied widely with respect to those described and illustrated by way of non-limiting example, without departing from the scope of the appended claims.

What is claimed is:

1. Apparatus for transferring liquid metals from a collection container (9) to a receiving container (1), characterized in that it comprises:

a receiving container in the form of a ladle (1) provided with a mouth (4) for the introduction of the metal, means (8) for transferring the liquid metal from a collection container (9) to the ladle (1), the means comprising a cover (7) which can engage the mouth (4) of the ladle (1) in a leaktight manner and which has a first opening (14) with which a liquid-transfer duct (11) is associated and at least one second opening (16) with which means (17, 18) for generating a reduced pressure are associated, and handling means (20) arranged for moving the transfer means (8) between a position in which the cover (7) engages the mouth (4) of the ladle (1) and the transfer duct (11) is immersed in the collection container (9), and a position of disengagement from the mouth (4) of the ladle (1).

2. Apparatus according to claim 1, characterized in that the handling means (20) comprise a hoist (22) with a pneumatic jack (23) to be connected to the cover (7).

3. Apparatus according to claim 1, characterized in that the handling means (20) comprise a pivotable arm (21) supporting the hoist (22).

4. Apparatus according to claim 1, characterized in that gas-blowing means (27, 28) are associated with the ladle (1) and are arranged in the base region of the ladle (1), in order to supply an inert gas into the metal bath contained in the ladle (1).

5. Apparatus according to claim 4, characterized in that the gas-blowing means comprise a gas-supply duct (27) communicating with a diffuser member comprising a porous ceramic partition (28).

6. Apparatus according to claim 1, characterized in that it comprises an auxiliary cover (7*a*) which can seal the mouth (4) of the ladle (1) in a leaktight manner and with which means (17, 18) for generating a reduced pressure and at least one gas-evacuation duct (26) are associated.

7. Apparatus according to claim 1, characterized in that there are associated with the cover (7, 7*a*) level-sensor means (24) arranged to generate a signal indicative of the level of liquid metal transferred into the ladle (1), and a control and operating unit, operatively associated with the level-sensor means (24) and arranged to receive the signal indicative of the metal level from the sensor means (24) and to interrupt the generation of reduced pressure when the level in the ladle (1) reaches a predetermined value.

* * * * *